US011035087B1

(12) United States Patent
Mattia

(10) Patent No.: US 11,035,087 B1
(45) Date of Patent: Jun. 15, 2021

(54) TRI-DIRECTIONAL TRAFFIC BOLLARD

(71) Applicant: Nick M Mattia, Penryn, CA (US)

(72) Inventor: Nick M Mattia, Penryn, CA (US)

( * ) Notice: Subject to any disclaimer, the term of this patent is extended or adjusted under 35 U.S.C. 154(b) by 215 days.

(21) Appl. No.: 16/266,246

(22) Filed: Feb. 4, 2019

(51) Int. Cl.
*E01F 9/619* (2016.01)
*E01F 9/692* (2016.01)
*E01F 9/654* (2016.01)
*E01F 13/02* (2006.01)

(52) U.S. Cl.
CPC ..... *E01F 9/619* (2016.02); *E01F 9/654* (2016.02); *E01F 9/692* (2016.02); *E01F 13/02* (2013.01)

(58) Field of Classification Search
CPC . E01F 9/619; E01F 9/654; E01F 9/692; E01F 13/02
USPC ..... 116/63 C, 63 P; 404/13
See application file for complete search history.

(56) References Cited

U.S. PATENT DOCUMENTS 3,672,323 A * 6/1972 Hawes ..... B60Q 7/005 116/28 R
5,560,732 A * 10/1996 Kulp ..... E01F 9/688 116/63 P
5,908,262 A * 6/1999 Ahn ..... E01F 9/675 404/9
6,579,035 B1 * 6/2003 Watson ..... E01F 9/559 404/12
7,338,229 B1 * 3/2008 Kuo ..... E01F 9/688 116/63 C
9,347,190 B2 * 5/2016 Mattia ..... E01F 9/688
9,512,578 B1 * 12/2016 Dvoracek ..... E01F 9/688
9,551,121 B2 * 1/2017 McCord ..... E01F 9/692
10,047,487 B2 * 8/2018 Kuo ..... E01F 9/688
10,487,464 B2 * 11/2019 Rich ..... E01F 9/654
2012/0234228 A1 * 9/2012 Kuo ..... E01F 9/688 116/63 C
2019/0040595 A1 * 2/2019 Utz ..... E01F 9/619

* cited by examiner

*Primary Examiner* — Gary S Hartmann
(74) *Attorney, Agent, or Firm* — Plager Schack LLP; Mark H. Plager; Michael J. O'Brien

(57) ABSTRACT

An improved tri-directional traffic bollard having a plurality of reflective members. The plurality of reflective members of the tri-directional traffic bollard can be viewed by the human eye from any direction, even when toppled or tipped over. The current invention provides a tri-directional traffic bollard comprising a main elongated body having a proximal end, a distal end, an internal face and an exterior face and a base member adjoined to the proximal end of the main elongated body. The tri-directional traffic bollard includes a plurality of reflective members adjoined to the any face of the main elongated body and the base member. The plurality of reflective members is aligned to be flush, raised or recessed within any face of the main elongated body or any face of the base member.

8 Claims, 20 Drawing Sheets

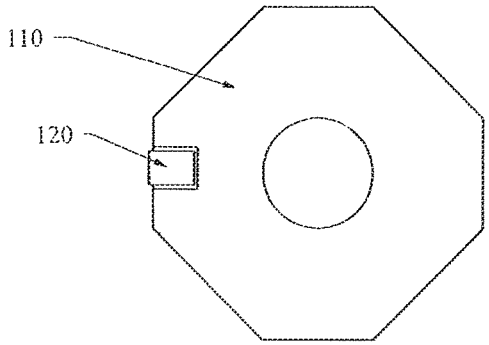
FG.11A
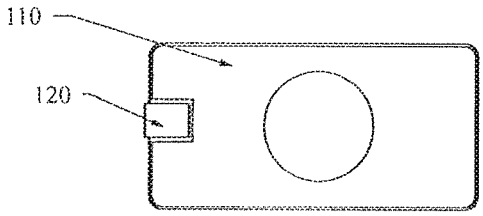
FG.11B
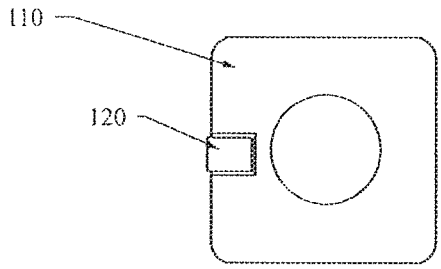
FG.11C
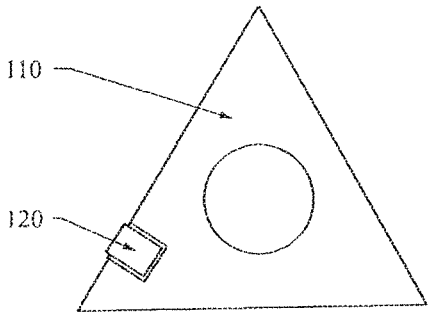
FG.11D
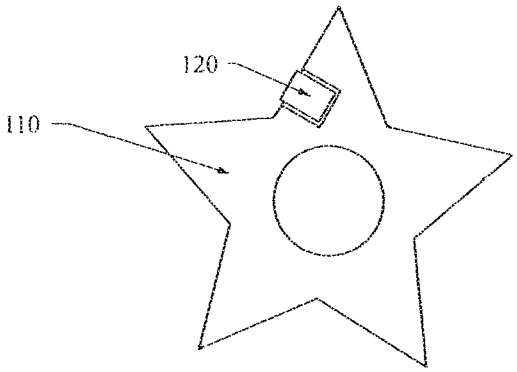
FG.11E

TRI-DIRECTIONAL TRAFFIC BOLLARD

BACKGROUND

The present invention relates to an improved tri-directional traffic bollard for improving bollard visibility when not in a resting upright position.

As used in this application a traffic bollard is a device for directing traffic that can include a traffic cone, a traffic delineator, a traffic tube, a traffic barrel, and a traffic drum.

Traditionally traffic bollards have been manufactured in many different sizes and shapes to match different traffic, safety and transportation scenarios. Traffic bollards are designed to rest in an upright position, usually with a large diameter base wherein the base keeps the traffic bollard in an upright resting position. Current traffic bollards have been designed with reflective material adjoined to or incorporated into the bollard material itself for many years. With a traffic bollard in an upright position, reflective material or signage is typically visibility to the eye from multiple directions. Problems begin to occur when traffic bollards are toppled or tipped over from their desired upright resting position. Traffic bollards can be toppled or tipped over in different ways including: contact with motor vehicles, movement induced by environmental elements and human interaction. Problems arise when traffic bollards are toppled or tipped over from the desired upright resting position and therefore colored or reflective surfaces of common traffic bollards lack visibility to the eye. When traffic bollards are not easily noticed by the eye, they provide no directional assistance or safety value to humans.

Traffic bollards are typically placed in hazardous locations, wherein extreme safety and caution is used when first placing the traffic bollards in a desired location. Furthermore, returning to place a traffic bollard back to an upright resting position once the traffic bollard has been toppled or tipped over puts the worker unnecessarily in a hazardous situation again. Reducing the time spent to return traffic bollards to an upright position or eliminating this hazardous task entirely would be ideal.

SUMMARY

The present invention relates to an improved tri-directional traffic bollard providing a plurality of reflective members to improve the available angles an onlooking human eye can see a colored or reflective member. The plurality of reflective members of the tri-directional traffic bollard can be viewed by the human eye from any direction, even when toppled or tipped over.

An object of the present invention is to drastically minimize or elevate the need for a human or a machine to return traffic bollard to a resting upright position when toppled or tipped over in different ways including: contact with motor vehicles, movement induced by environmental elements and human interaction.

In order to do so, a tri-directional traffic bollard is provided comprising a main elongated body having a proximal end, a distal end, an internal face and an exterior face and a base member adjoined to the proximal end of the main elongated body. The base member having a top face, a perimeter face and a bottom face, wherein the base member aligns the main elongated body to be perpendicular to a surface below the tri-directional traffic bollard and a first opening is arranged between the top face and the bottom face of the base member. The first opening is also aligned in the middle of the base member, wherein the main elongated body protrudes through the first opening. The tri-directional traffic bollard includes a plurality of reflective members adjoined to the exterior face of the main elongated body and the base member, wherein at least one of the plurality of reflective members is adjoined to each face of the base member.

BRIEF DESCRIPTION OF THE FIGURES

The detailed description of some embodiments of the invention is made below with reference to the accompanying figures, wherein like numerals represent corresponding parts of the figures.

The novel features of the disclosure are set forth with particularity in the appended claims. A better understanding of the features and advantages of the present disclosure will be obtained by reference to the following detailed description that sets forth illustrative embodiments, in which the principles of the disclosure are utilized, and the accompanying drawings of which:

FIG. 11A show a bottom view of one embodiment of the base member and one embodiment of the plurality of reflective members adjoined thereto.

FIG. 11B show a bottom view of one embodiment of the base member and one embodiment of the plurality of reflective members adjoined thereto.

FIG. 11C show a bottom view of one embodiment of the base member and one embodiment of the plurality of reflective members adjoined thereto.

FIG. 11D show a bottom view of one embodiment of the base member and one embodiment of the plurality of reflective members adjoined thereto.

FIG. 11E show a bottom view of one embodiment of the base member and one embodiment of the plurality of reflective members adjoined thereto.

DETAILED DESCRIPTION OF CERTAIN EMBODIMENTS

Figure 1:
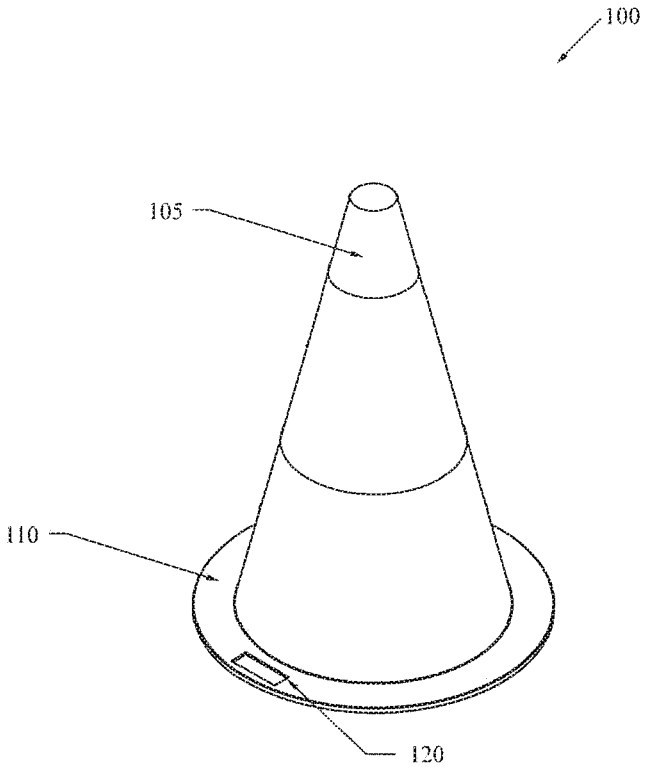
FIG. 1 shows an exemplary perspective view of one embodiment of the tri-directional traffic bollard.
Figure 2:
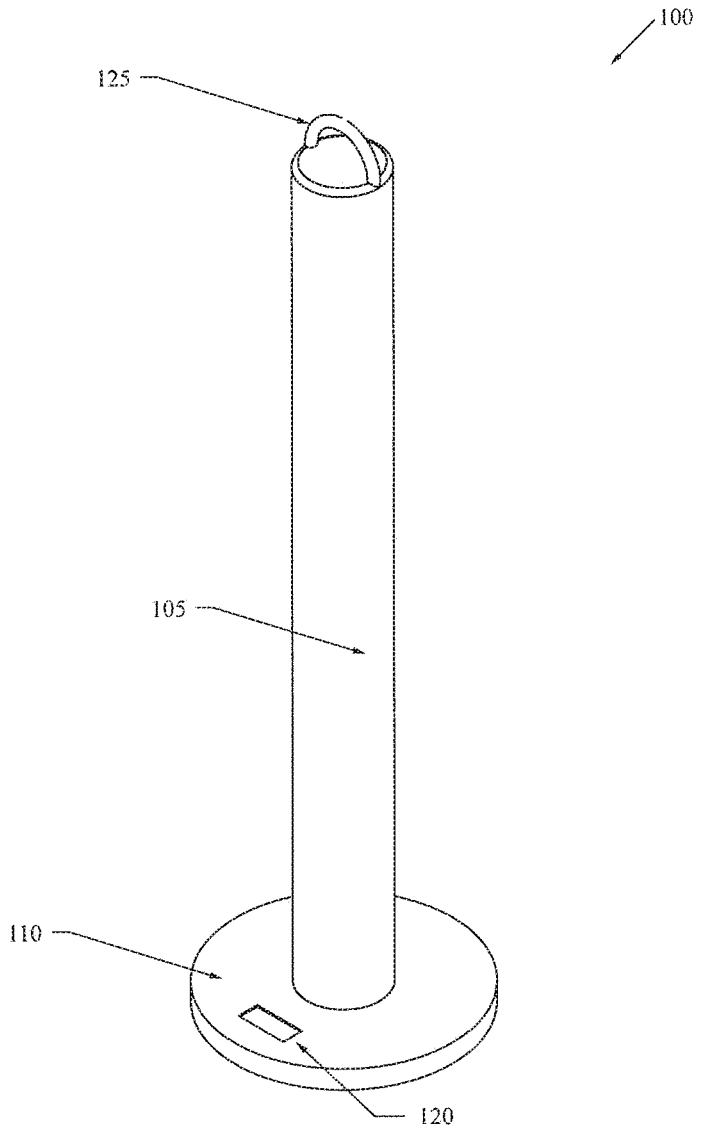
FIG. 2 shows an exemplary perspective view of one embodiment of the tri-directional traffic bollard.
Figure 3:
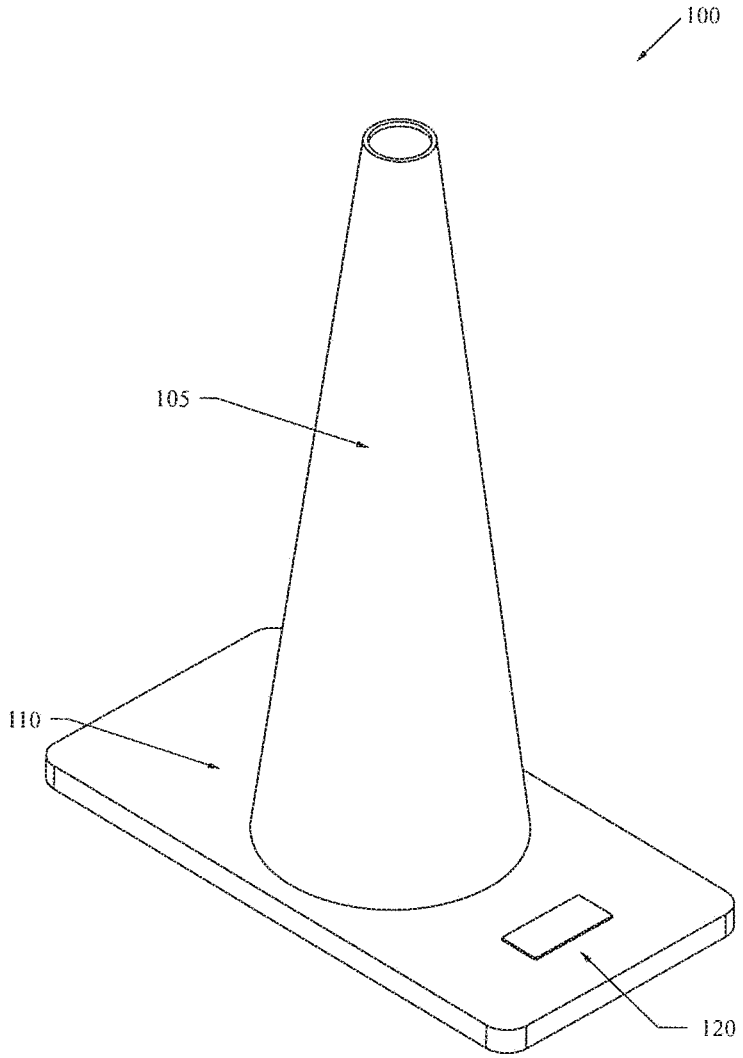
FIG. 3 shows an exemplary perspective view of one embodiment of the tri-directional traffic bollard.
Figure 4:
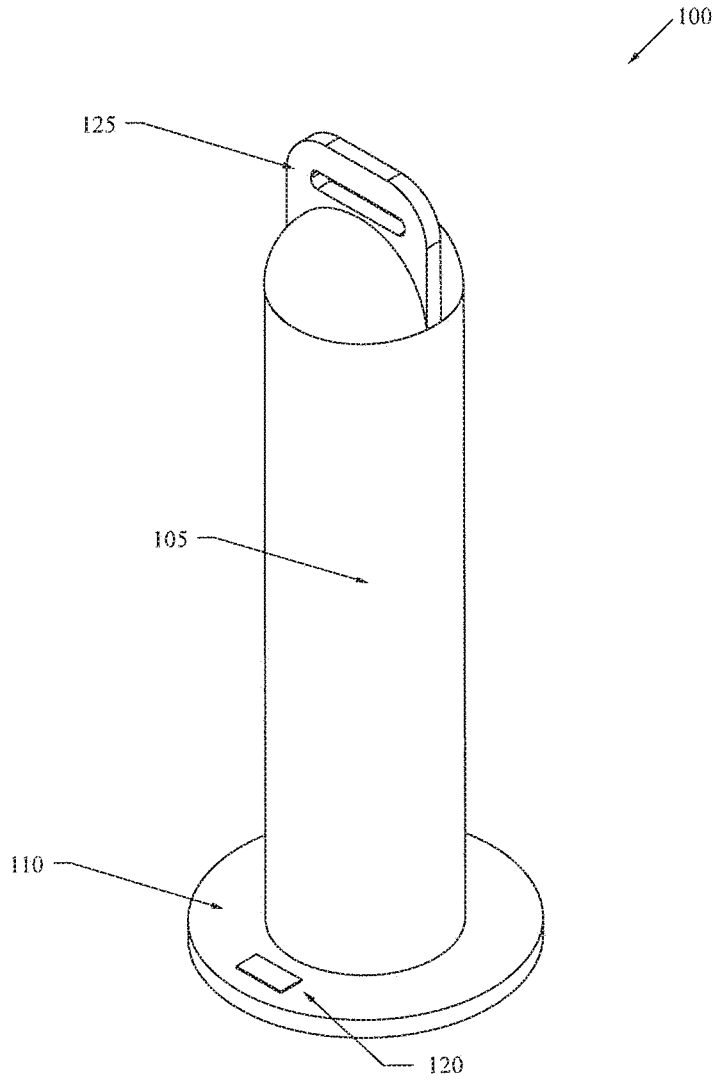
FIG. 4 shows an exemplary perspective view of one embodiment of the tri-directional traffic bollard.
Figure 5:
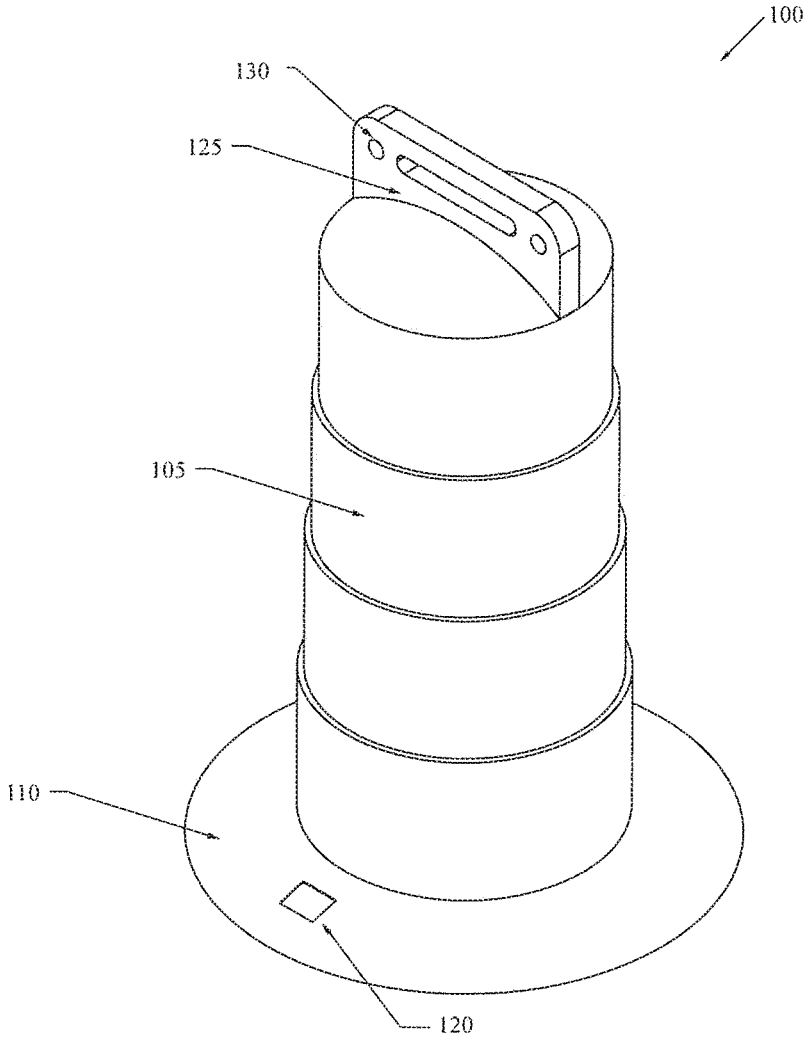
FIG. 5 shows an exemplary perspective view of one embodiment of the tri-directional traffic bollard.
Figure 6:
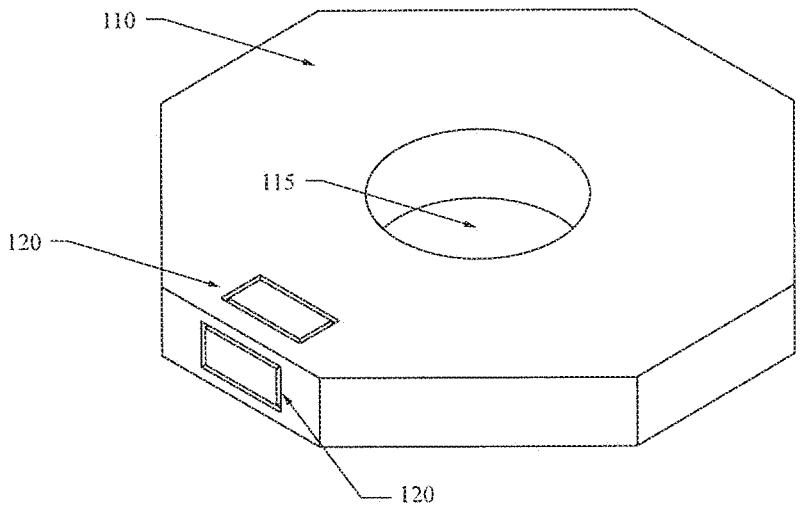
FIG. 6 shows an exemplary perspective view of one embodiment of the base member of the tri-directional traffic bollard.
Figure 7:
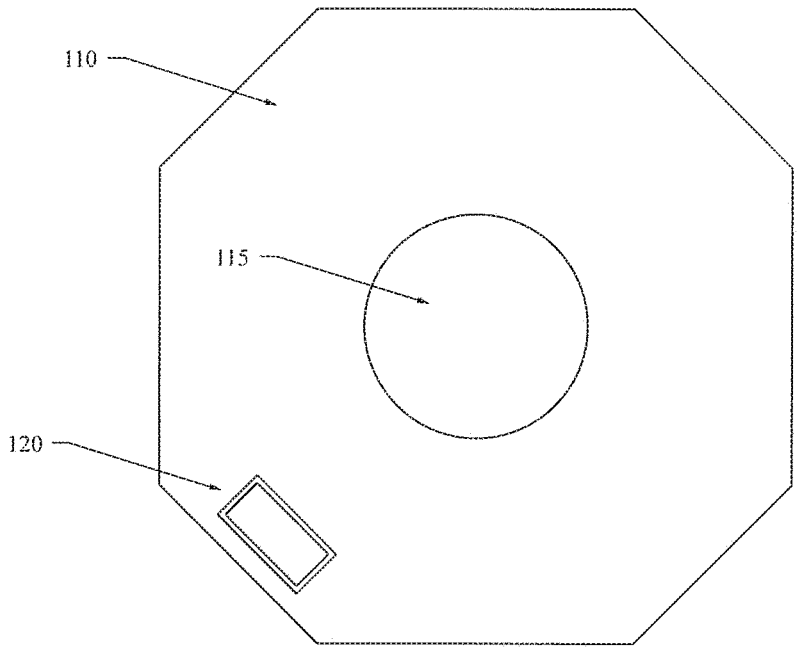
FIG. 7 shows an exemplary bottom view of one embodiment of the base member of the tri-directional traffic bollard.

While preferred embodiments of the present disclosure have been shown and described herein, it will be obvious to those skilled in the art that such embodiments are provided by way of example only. Numerous variations, changes, and substitutions will now occur to those skilled in the art without departing from the disclosure. It should be understood that various alternatives to the embodiments of the disclosure described herein may be employed in practicing the disclosure.

FIG. 1-5 shows an exemplary perspective view of one embodiment of the tri-directional traffic bollard 100. The tri-directional traffic bollard 100 having a main elongated body 105 having a proximal end, a distal end, an internal face and an exterior face and a base member 110 adjoined to the proximal end of the main elongated body 105. The base member 110 having a top face, a perimeter face and a bottom face. In some embodiments, the base member 110 has a first opening 115 cut between the top face and the bottom face of the base member 110 and aligned in the middle of the base member 110, wherein the main elongated body 105 protrudes through the first opening 115. The base member 110 aligns the main elongated body 105 to be perpendicular to a surface below the tri-directional traffic bollard. The main elongated body 105 can be any of the shapes shown in FIGS. 1-5 or any other traffic-related or common safety shape known to one skilled in the art. In some embodiments, the distal end of the main elongated body 105 further comprises a handle 125 or at least one hole 130, wherein the traffic bollard can be lifted by the handle 125 or at least one hole 130. The handle 125 and at least one hole 130 can be used to adjoin a safety tape, a sign or rope if needed. The main elongated body 105 can be at least one shape chosen from body shape set consisting of: a conical shape, a cylindrical shape, a cubical shape, a square shape, and a tiered shape. In some embodiments, the main elongated body 105 and base member 110 are one continuous piece. In the present exemplary embodiment, the main elongated body 105 is inserted through the first opening 115 and adjoined to the base member 110 by at least one member of an attachment set consisting of: a snap fit, an adhesive, a threaded connection, a magnet, a press fit, a fastener, a spring, a clamp, a clip, a heat-shrink material, and an elastic member.

Figure 8:
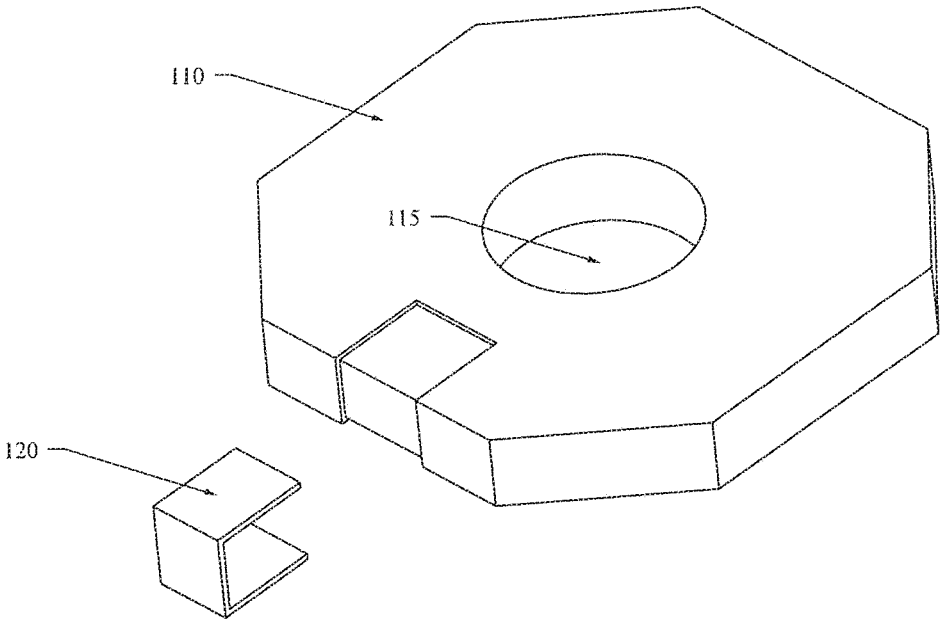
FIG. 8 shows an exemplary perspective view of one embodiment of the base member of the tri-directional traffic bollard.
Figure 9:
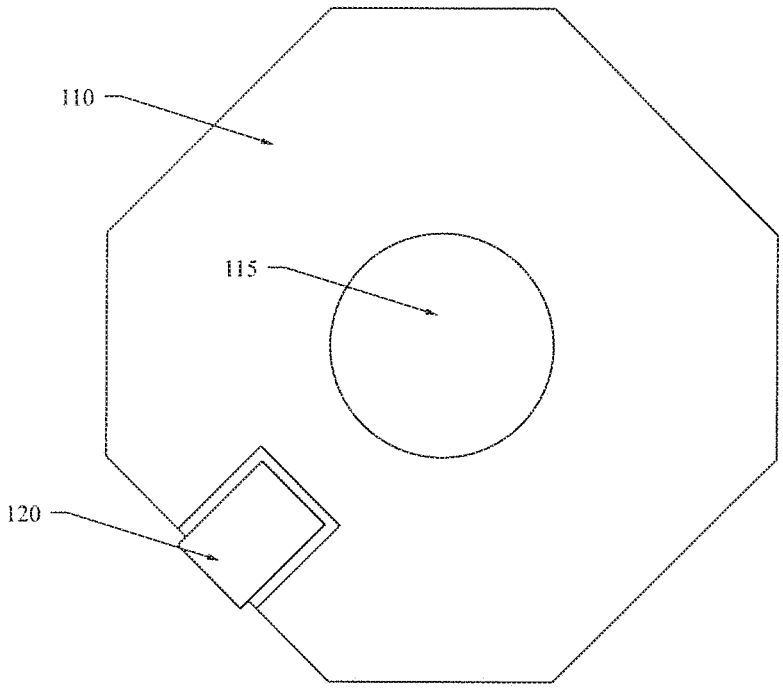
FIG. 9 shows an exemplary bottom view of one embodiment of the base member of the tri-directional traffic bollard.
Figure 10A:
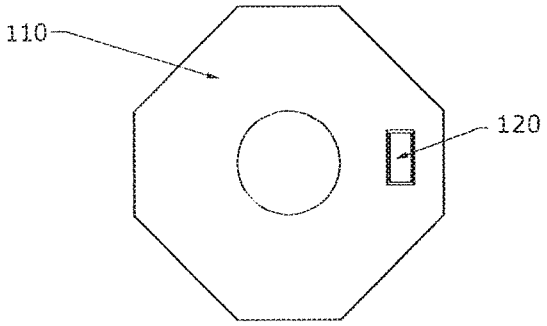
FIG. 10A show a bottom view of one embodiment of the base member and one embodiment of the plurality of reflective members adjoined thereto.
Figure 10B:
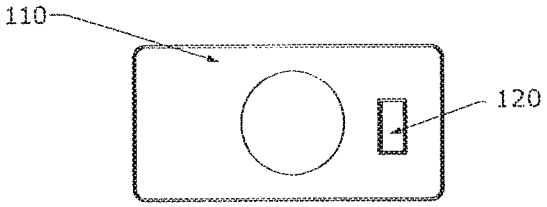
FIG. 10B show a bottom view of one embodiment of the base member and one embodiment of the plurality of reflective members adjoined thereto.
Figure 10C:
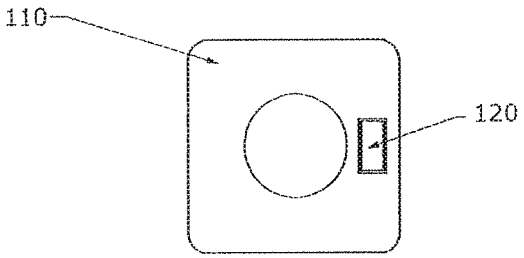
FIG. 10C show a bottom view of one embodiment of the base member and one embodiment of the plurality of reflective members adjoined thereto.
Figure 10D:
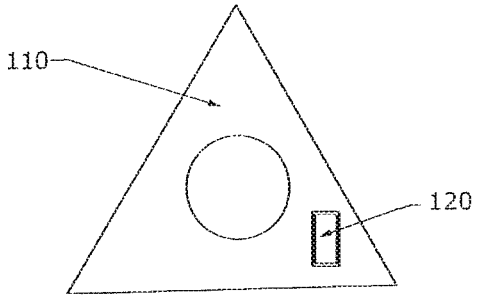
FIG. 10D show a bottom view of one embodiment of the base member and one embodiment of the plurality of reflective members adjoined thereto.
Figure 10E:
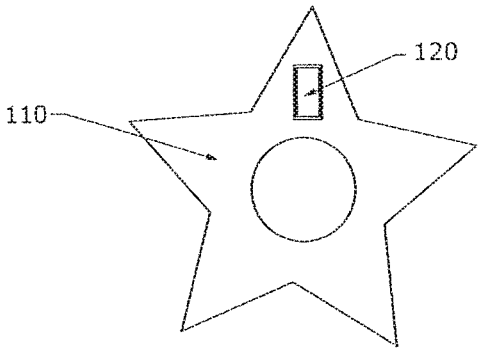
FIG. 10E show a bottom view of one embodiment of the base member and one embodiment of the plurality of reflective members adjoined thereto.
Figure 12A:
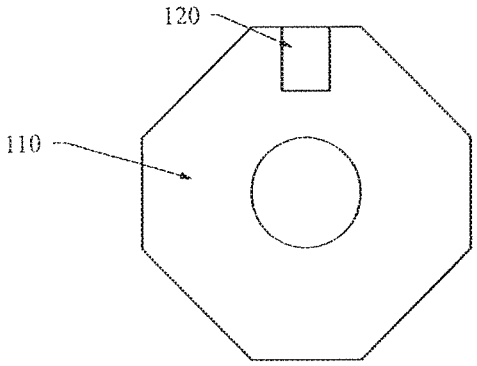
FIG. 12A show a bottom view of one embodiment of the base member and one embodiment of the plurality of reflective members adjoined thereto.
Figure 12B:
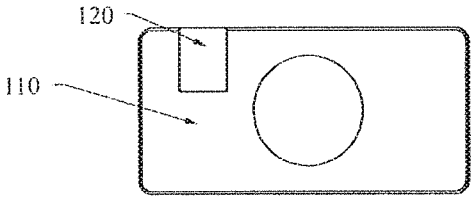
FIG. 12B show a bottom view of one embodiment of the base member and one embodiment of the plurality of reflective members adjoined thereto.
Figure 12C:
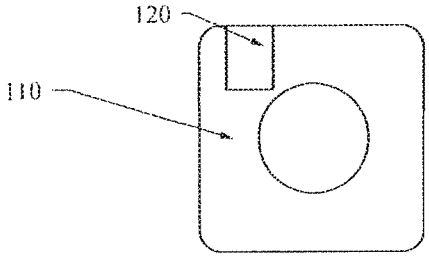
FIG. 12C show a bottom view of one embodiment of the base member and one embodiment of the plurality of reflective members adjoined thereto.
Figure 12D:
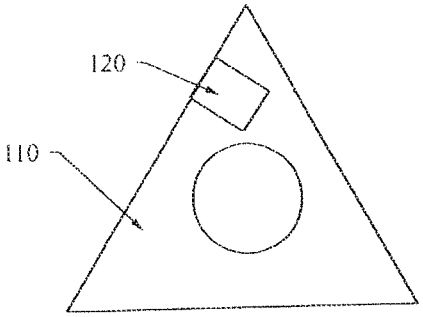
FIG. 12D show a bottom view of one embodiment of the base member and one embodiment of the plurality of reflective members adjoined thereto.
Figure 12E:
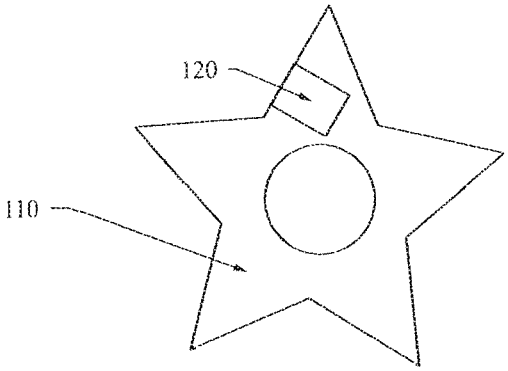
FIG. 12E show a bottom view of one embodiment of the base member and one embodiment of the plurality of reflective members adjoined thereto.
Figure 13:
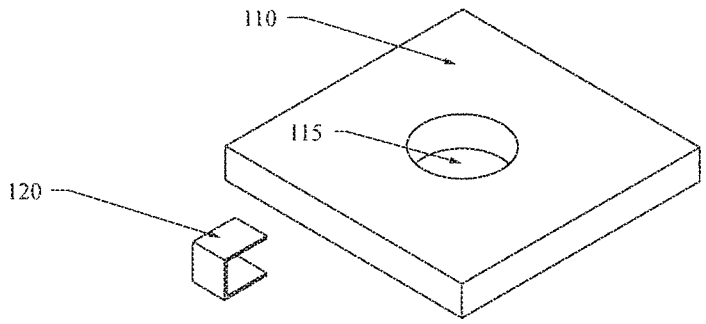
FIG. 13 shows an exemplary perspective view of one embodiment of the base member of the tri-directional traffic bollard.
Figure 14:
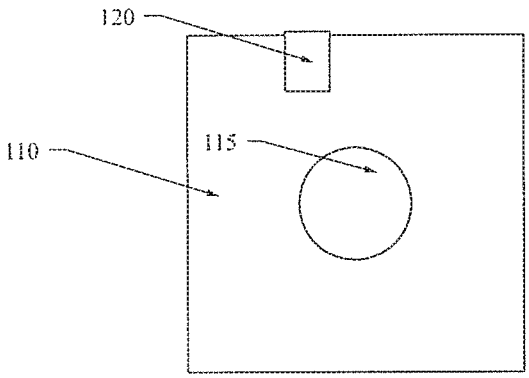
FIG. 14 shows an exemplary bottom view of one embodiment of the base member of the tri-directional traffic bollard.

As shown in FIGS. 6-14 the tri-directional traffic bollard 100 comprises of a plurality of reflective members 120 adjoined to the exterior face of the main elongated body and the base member, wherein at least one of the plurality of reflective members 120 is adjoined to each of the faces of the base member 110. The plurality of reflective members 120 are adjoined by at least one member of the attachment set. In some embodiments, the plurality of reflective members 120 further comprise a reflective tape material adhered to any face of the base member or any face the elongated body. In some embodiments, the main elongated body 105 is made entirely from a reflective material. As shown in FIGS. 8 and 9, the plurality of reflective members can be made to clip or slide into a groove in the base member 110. As shown in FIGS. 13 and 14, in some embodiments the plurality of reflective members can comprise a bracket inserted over and adjoined to base member 110. The plurality of reflective members 120 can align to be flush, raised or recessed within any face of the main elongated body 105 or any face of the base member 110.

FIGS. 10A-10E shows exemplary base member 110 shape configurations for an embodiment of the tri-directional traffic bollard 100 having a plurality of reflective members 120 inlayed into the base member 110. FIGS. 10A-10E shows exemplary base member 110 shape configurations for an embodiment of the tri-directional traffic bollard 100 having a plurality of reflective members 120 inserting into a groove in the base member 110. FIGS. 10A-10E shows exemplary base member 110 shape configurations for an embodiment of the tri-directional traffic bollard 100 having a plurality of reflective members 120 as a bracket that in inserted over and adjoined to the base member 110.

In some embodiments, the plurality of reflective members are made by at least one of the following manufacturing processes of a manufacturing set consisting of: an injection molding process, a cutting process, a machining process, an extrusion blow molding, an injection blow molding process, a vacuum forming process, a 3D printing process, a compression molding process, a thermoforming process, a casting process, an extrusion process, and a rotational molding process. In some embodiments, the main elongated body 105 is made by at least one of the manufacturing processes of the manufacturing set. In some embodiments, the base member 110 is made by at least one of the manufacturing processes of the manufacturing set. In some embodiments, at least one of the following manufacturing processes of the manufacturing set includes a removable insert, wherein the insert creates a cavity that the plurality of reflective members are inserted into. In some embodiments, a permanent insert (not shown) is left within the within the tri-directional traffic bollard during at least one of the following manufacturing processes of the manufacturing set. The permanent insert is therein incorporated into the base member 110 or the main elongated body 105. In some embodiments, the permanent insert is designed to increase the bonding strength between the plurality of reflective members are the base member 110 or main elongated body 105.

In some embodiments, the tri-directional traffic bollard is subject to a spraying or pouring of a liquid material aiding in the attachment of the plurality of reflective members. In some embodiments, the entirety of the base member can be dipped into a liquid material wherein the liquid aides in the adhesion of the plurality of reflective members. In some embodiments, when a member of the tri-directional traffic bollard is machined or cut after being formed, the area of the material removed can filled with a reflective material. The reflective material can be any material known to one skilled in the art to effectively reflect light.

In some embodiments, the bottom face of the base member 110 further comprises an external texture (not shown) to grip the surface below the tri-directional traffic bollard 100. In some embodiments, the external texture comprises at least one member of a texture set consisting of: indentations, extrusions, knurling, a rough surface, and bumps. In some embodiment, the bottom surface has no external texture. The external texture aides in keeping the tri-directional traffic bollard from tipping over and aiding in keeping the tri-directional traffic bollard 100 in one place.

Figure 15:
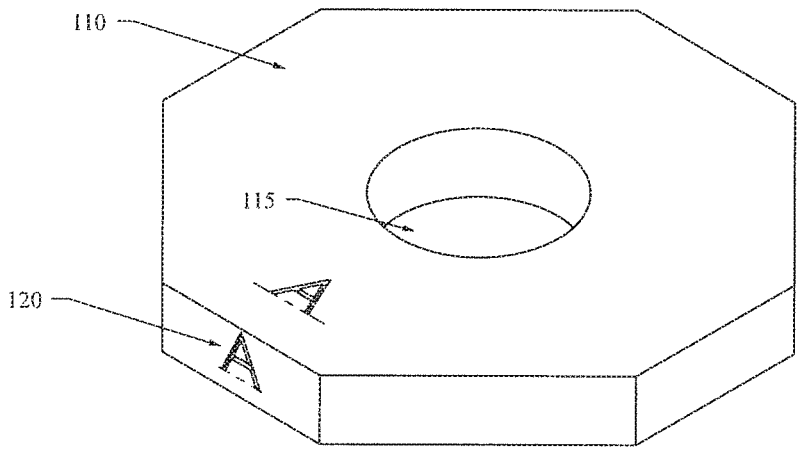
FIG. 15 shows an exemplary perspective view of one embodiment of the base member of the tri-directional traffic bollard.
Figure 16:
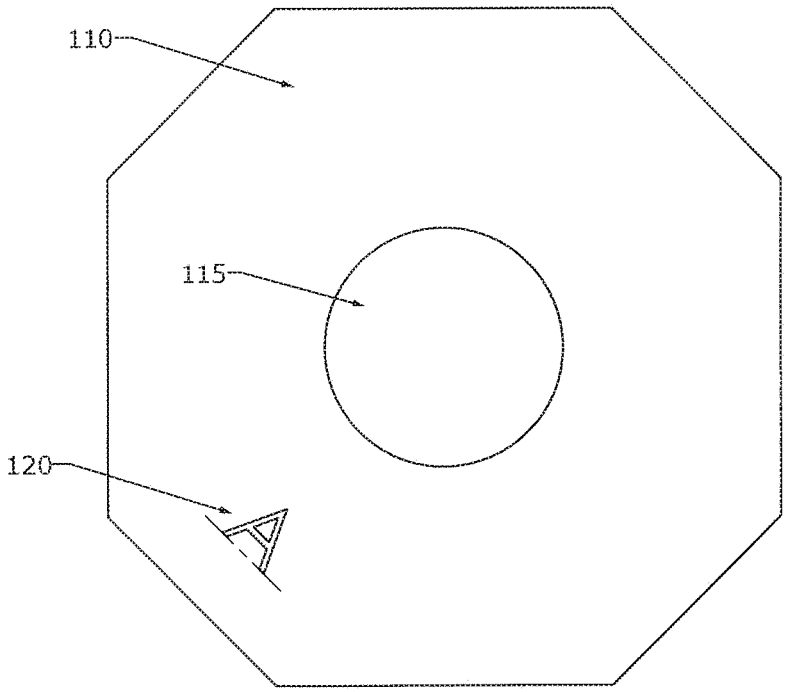
FIG. 16 shows an exemplary bottom view of one embodiment of the base member of the tri-directional traffic bollard.
Figure 17:
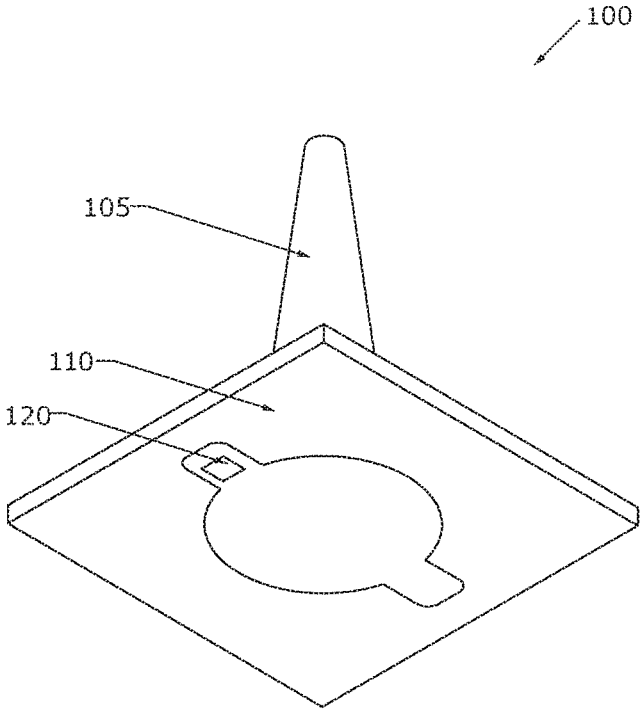
FIG. 17 shows an exemplary perspective view of one embodiment of the tri-directional traffic bollard.
Figure 18:
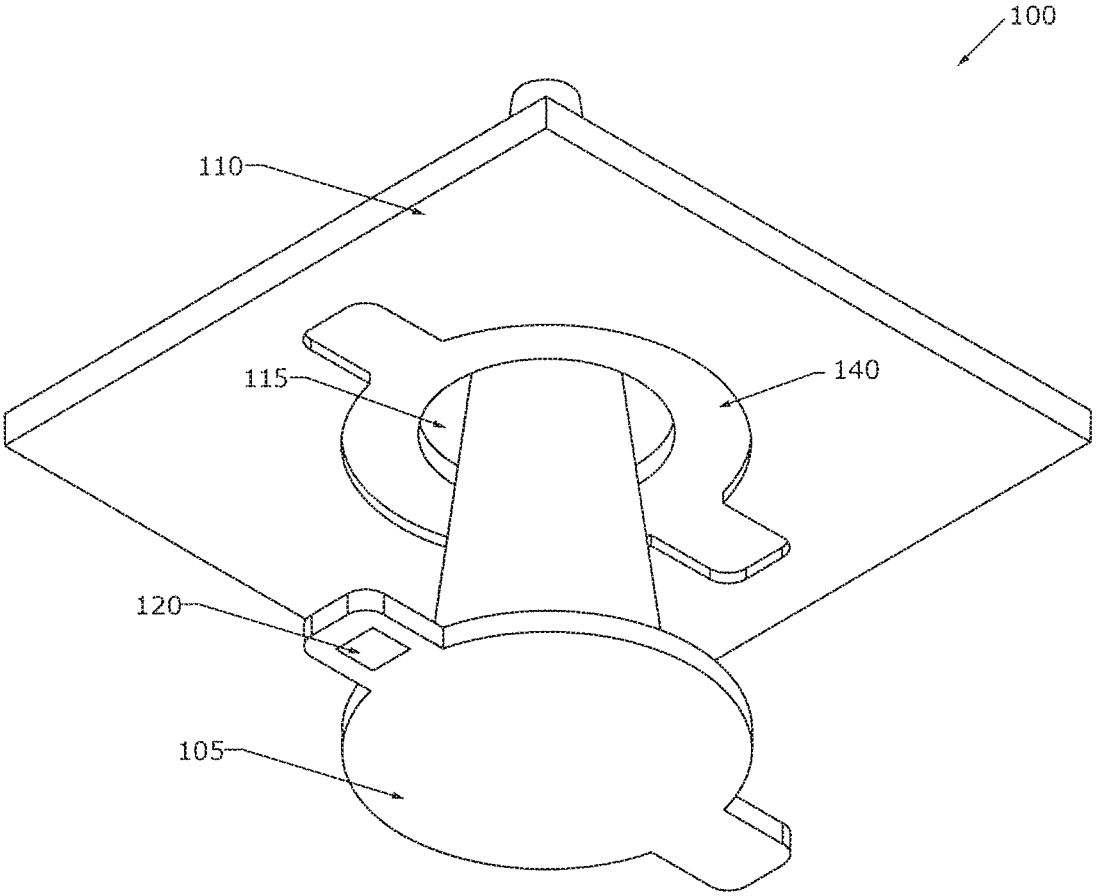
FIG. 18 shows an exemplary perspective view of one embodiment of the tri-directional traffic bollard.

As shown in FIGS. 15-16, in some embodiments, the plurality of reflective members 120 further comprises at least one member of an identification set consisting of: an alphanumeric identification, a human user's name, a symbolic shape, a company brand, a numeric identification number, a QR code, a barcode, and an RFID tag.

Figure 19:
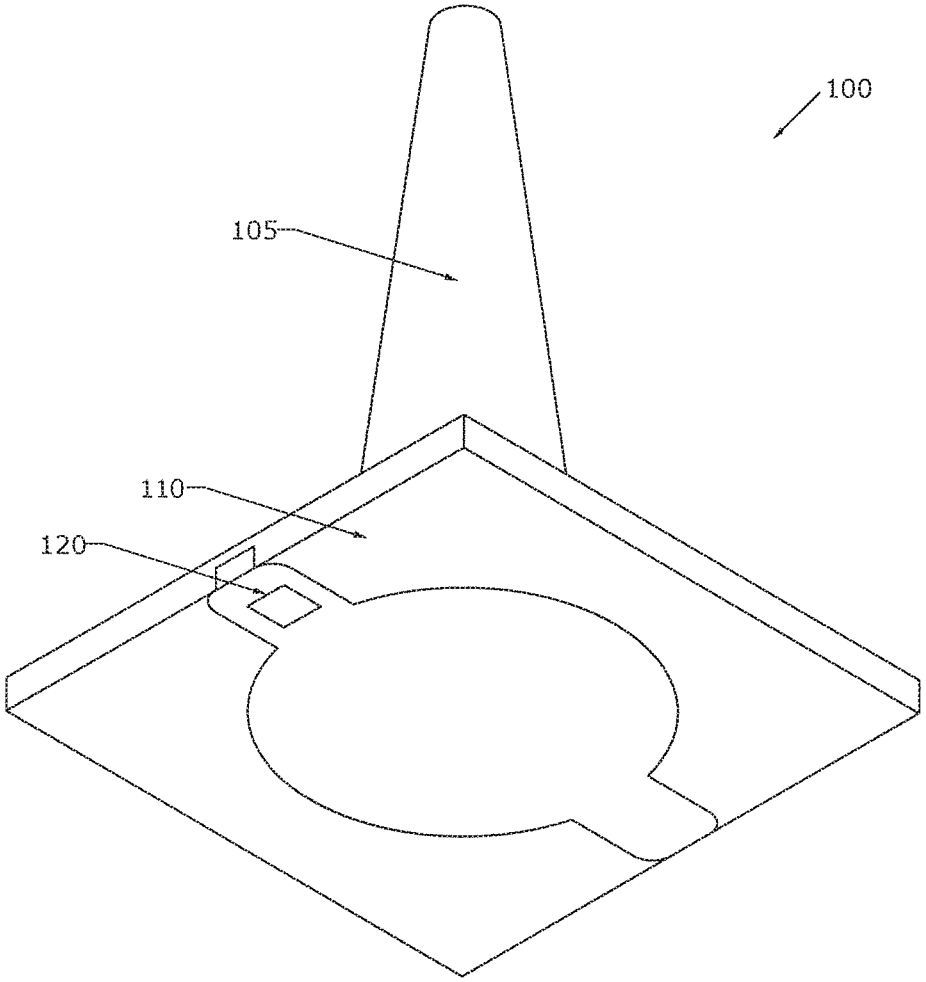
FIG. 19 shows an exemplary perspective view of one embodiment of the tri-directional traffic bollard.
Figure 20:
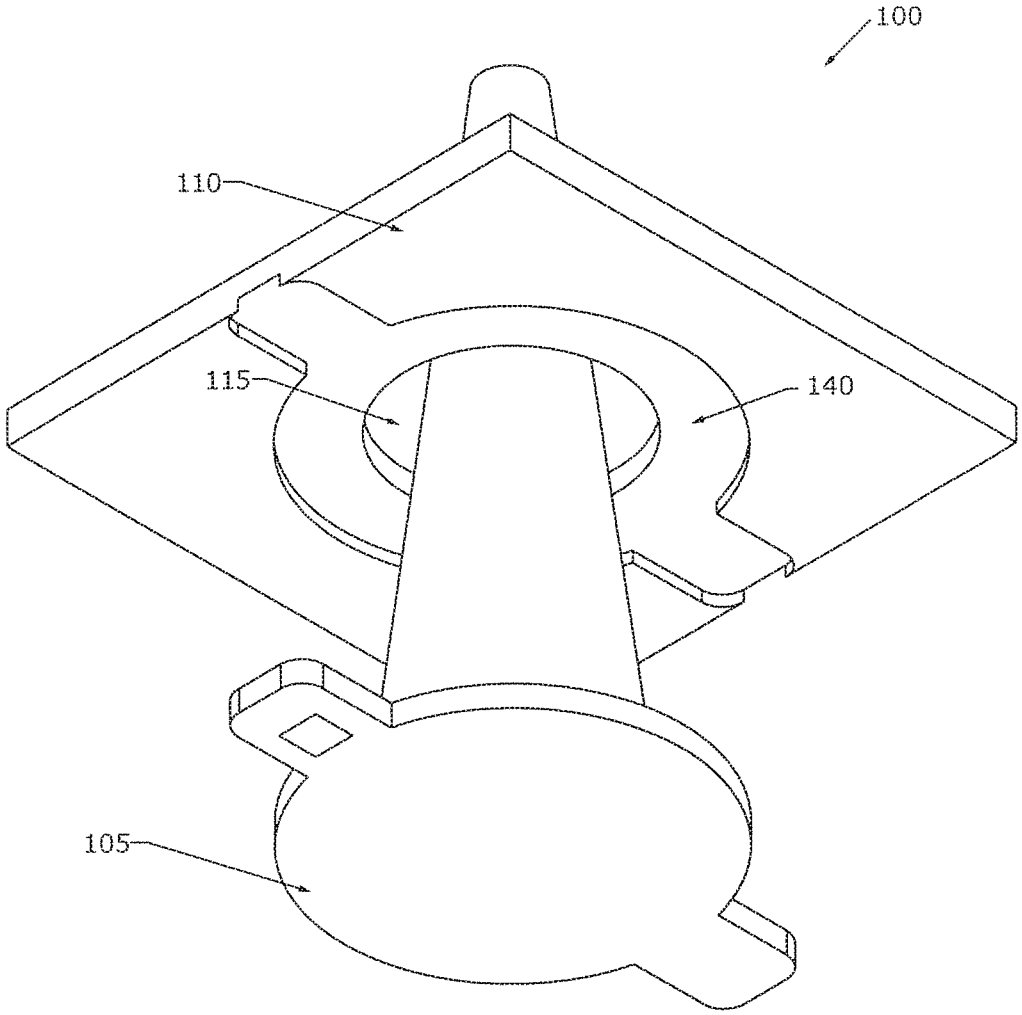
FIG. 20 shows an exemplary perspective view of one embodiment of the tri-directional traffic bollard.

As shown in FIGS. 17-20 in some embodiments, the main elongated body 105 can be inserted through the first opening 115 during assembly and seat into a pocket 140. After inserting the distal end of the main elongated body 105 through the first opening 115 the proximal end of the main elongated body 105 rests within the pocket. In some embodiments, the proximal end of the elongated body and the pocket can protrude through the perimeter edge of the base member 110, as shown in FIGS. 19 & 20. In this embodiment, the pocket 140 of the base member 110 can be adjoined to the proximal end of the elongated body by at least one member of the attachment set. In some embodiments, the main elongated body 105 and the first opening 115 can be located outside the center of the base member 110 at any location of the top face and bottom face of the base member.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

Unless otherwise defined, all technical terms used herein have the same meaning as commonly understood by one of ordinary skill in the art to which this disclosure belongs.

As used herein, the singular forms "a," "an," and "the" include plural references unless the context clearly dictates otherwise. Any reference to "or" herein is intended to encompass "and/or" unless otherwise stated.

As used herein, the term "about" refers to an amount that is near the stated amount by about 0%, 5%, or 10%, including increments therein.

Unless otherwise defined, all technical terms used herein have the same meaning as commonly understood by one of ordinary skill in the art to which this disclosure belongs.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A tri-directional traffic bollard for improving visibility from multiple angles the tri-directional traffic bollard comprising:

a main elongated body having a proximal end, a distal end, an internal face and an exterior face;

a base member adjoined to the proximal end of the main elongated body and having a top face, a perimeter face and a bottom face; wherein the base member aligns the main elongated body to be perpendicular to a surface below the tri-directional traffic bollard;

a first opening arranged between the top face and the bottom face of the base member and aligned in the middle of the base member; wherein the main elongated body protrudes through the first opening;

a groove, arranged on the top face, the bottom face, and the perimeter face creating a c-shaped channel;

at least one reflective member filling the groove; and a plurality of additional reflective members adjoined to the exterior face of the main elongated body and the base member; wherein at least one of the plurality of additional reflective members is adjoined to each face of the base member.

2. The tri-directional traffic bollard of claim 1, wherein the base member further comprises a pocket; wherein after inserting the distal end of the main elongated body through the first opening the proximal end of the main elongated body rests within the pocket.

3. The tri-directional traffic bollard of claim 1, wherein the main elongated body is at least one shape of a body shape set consisting of: a conical shape, a cylindrical shape, a cubical shape, a square shape, and a tiered shape.

4. The tri-directional traffic bollard of claim 1, wherein the plurality of additional reflective members is adjoined by at least one member of an attachment set consisting of: a snap fit, an adhesive, a magnet, a press fit, a fastener, a spring, a clamp, a clip, a heat-shrink material, and an elastic member.

5. The tri-directional traffic bollard of claim 1, wherein the main elongated body is made of a reflective material.

6. The tri-directional traffic bollard of claim 1, wherein the plurality of additional reflective members further comprises at least one member of an identification set consisting of: an alphanumeric identification, a human user's name, a symbolic shape, a company brand, a numeric identification number, a QR code, a barcode, and an RFID tag.

7. The tri-directional traffic bollard of claim 1, wherein the bottom face of the base member further comprises an external texture to grip the surface below the tri-directional traffic bollard.

8. The tri-directional traffic bollard of claim 7, wherein the external texture further comprises at least one member of a texture set consisting of: indentations, extrusions, knurling, a rough surface, and bumps.

* * * * *